US010577882B2

(12) United States Patent
Hulsewe

(10) Patent No.: US 10,577,882 B2
(45) Date of Patent: Mar. 3, 2020

(54) WHIPSTOCK/BOTTOM HOLE ASSEMBLY INTERCONNECTION AND METHOD

(71) Applicant: Ewoud Hulsewe, The Woodlands, TX (US)

(72) Inventor: Ewoud Hulsewe, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 227 days.

(21) Appl. No.: 15/414,276

(22) Filed: Jan. 24, 2017

(65) Prior Publication Data

US 2018/0209233 A1 Jul. 26, 2018

(51) Int. Cl.
*E21B 29/06* (2006.01)
*E21B 7/06* (2006.01)

(52) U.S. Cl.
CPC ..... *E21B 29/06* (2013.01); *E21B 7/061* (2013.01)

(58) Field of Classification Search
CPC ..... E21B 29/06; E21B 7/061; E21B 12/00
See application file for complete search history.

(56) References Cited

U.S. PATENT DOCUMENTS 5,803,176 A 9/1998 Blizzard, Jr. et al.
5,878,818 A 3/1999 Hebert et al.
6,464,002 B1 * 10/2002 Hart ..... E21B 7/061 166/117.6
6,695,056 B2 * 2/2004 Haugen ..... E21B 7/061 166/117.6
7,878,253 B2 2/2011 Stowe et al.
(Continued)

FOREIGN PATENT DOCUMENTS

EP 0916014 A1 5/1999
WO 2016209686 A1 12/2016

OTHER PUBLICATIONS

Notification of Transmittal of the International Search Report and the Written Opinion of the International Searching Authority, or the Declaration; PCT/US2017/066117; dated Mar. 29, 2018; 13 pages.
(Continued)

*Primary Examiner* — Nicole Coy
(74) *Attorney, Agent, or Firm* — Cantor Colburn LLP

(57) ABSTRACT

A whipstock interconnection body including a whipstock interface, a bottom hole assembly (BHA) interface, the BHA interface including a feature configured to inherently grip the BHA. A whipstock interconnection body including a whipstock interface, a bottom hole assembly (BHA) interface, the BHA interface configured for attachment to a back surface of the whipstock. A whipstock/BHA assembly including a whipstock, a BHA, a whipstock interconnection body releasably securing the whipstock to the BHA, the whipstock interconnection body including a whipstock interface, a bottom hole assembly (BHA) interface, the BHA interface including a feature configured to inherently grip the BHA. A whipstock/BHA assembly including a whipstock, a BHA, a whipstock interconnection body releasably securing the whipstock to the BHA, the whipstock interconnection body including a whipstock interface, a bottom hole assembly (BHA) interface, the BHA interface configured for attachment to a back surface of the whipstock.

10 Claims, 3 Drawing Sheets

(56) References Cited

U.S. PATENT DOCUMENTS

| | | | | |
|---|---|---|---|---|
| 8,327,944 | B2 * | 12/2012 | King | E21B 12/00 166/117.5 |
| 8,967,279 | B2 | 3/2015 | Hered et al. | |
| 2004/0238171 | A1 | 12/2004 | McGarian et al. | |
| 2007/0044954 | A1 | 3/2007 | Dewey | |
| 2009/0266544 | A1 | 10/2009 | Redlinger et al. | |
| 2010/0270031 | A1 | 10/2010 | Patel | |
| 2010/0319997 | A1 | 12/2010 | King et al. | |
| 2012/0255785 | A1 | 10/2012 | Gregurek et al. | |
| 2012/0261193 | A1 | 10/2012 | Swadi et al. | |
| 2013/0020084 | A1 | 1/2013 | Goodson | |
| 2016/0238055 | A1 | 8/2016 | Donovan | |
| 2018/0209232 | A1 | 7/2018 | Hulsewe | |

OTHER PUBLICATIONS

Notification of Transmittal of the International Search Report and the Written Opinion of the International Searching Authority, or the Declaration; PCT/US2017/066119; dated Mar. 29, 2018; 10 pages.

* cited by examiner

WHIPSTOCK/BOTTOM HOLE ASSEMBLY INTERCONNECTION AND METHOD

BACKGROUND

In the downhole industry, whipstocks or other diverting tools are often run into a borehole hanging from the end of a milling or drilling bottom hole assembly (BHA) so that the whipstock may be positioned and anchored and then the BHA actuated to create the desired borehole exit (and potentially lateral borehole) in a single run. This methodology is well known to the industry. The whipstock is conventionally attached to the BHA by a configuration colloquially known as a lug. The lug generally extends through a portion of the whipstock and into connection with the BHA. The connection with the BHA generally requires a specially created interface such as a milled slot.

During use, the whipstock is landed and then torque, slack weight or both are used to shear the lug thereby disconnecting the BHA from the whipstock and the milling or drilling operation can begin.

Systems as described work well for their intended purposes but research effort has been applied to enhancing the connection between the whipstock and BHA during running to discourage or prevent premature separation and at the same time to reduce required input to cause the separation at the appropriate time. While alternatives have been proposed, they have not satiated the need and hence the art still pines for new solutions.

SUMMARY

A whipstock interconnection body including a whipstock interface, a bottom hole assembly (BHA) interface, the BHA interface including a feature configured to inherently grip the BHA.

A whipstock interconnection body including a whipstock interface, a bottom hole assembly (BHA) interface, the BHA interface configured for attachment to a back surface of the whipstock.

A whipstock/BHA assembly including a whipstock, a BHA, a whipstock interconnection body releasably securing the whipstock to the BHA, the whipstock interconnection body including a whipstock interface, a bottom hole assembly (BHA) interface, the BHA interface including a feature configured to inherently grip the BHA.

A whipstock/BHA assembly including a whipstock, a BHA, a whipstock interconnection body releasably securing the whipstock to the BHA, the whipstock interconnection body including a whipstock interface, a bottom hole assembly (BHA) interface, the BHA interface configured for attachment to a back surface of the whipstock

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
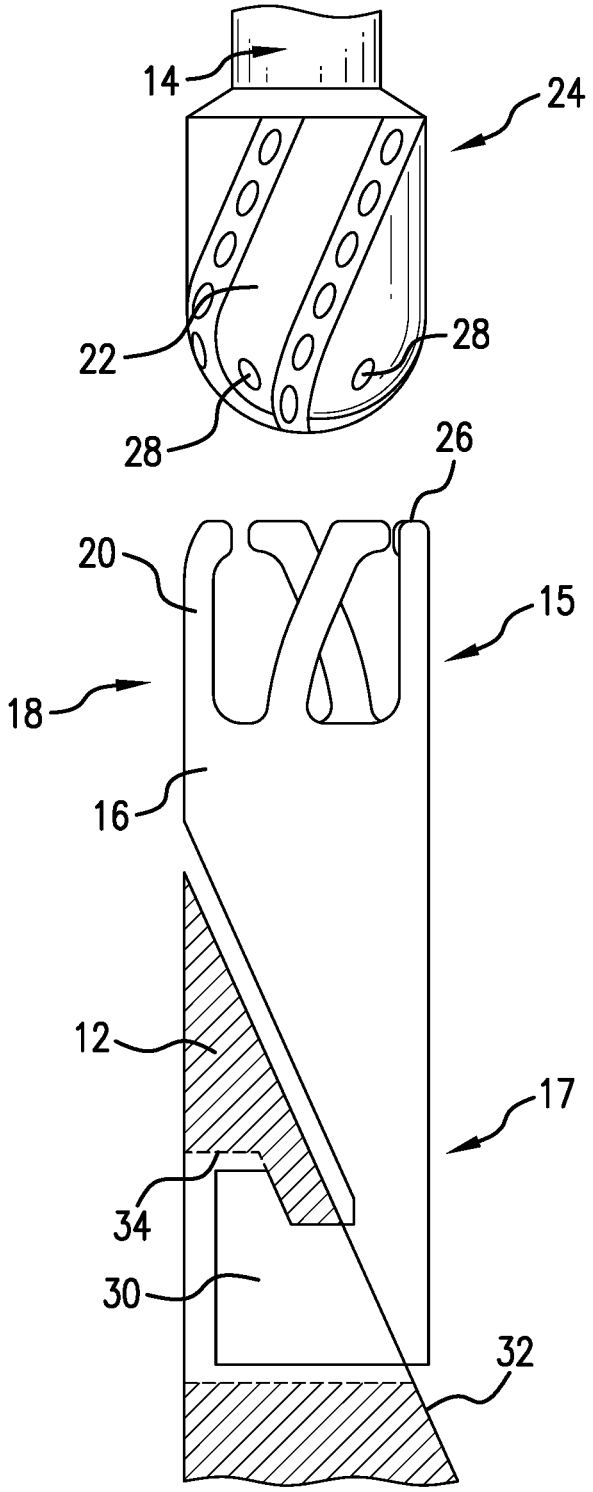
FIG. 1 is a schematic view of an embodiment of a whipstock, bottom hole assembly and whipstock interconnection body.

Referring to FIG. 1, a first embodiment of a whipstock and bottom hole assembly (BHA) arrangement 10 is illustrated with the whipstock 12 and the BHA 14 interconnected by an interconnection body 16, having a BHA connection end 15 and a whipstock connection end 17. The body 16 may be constructed of material that is easily drillable or millable in some embodiments. Contemplated materials include composite materials and soft metals among other suitable substitutes. At whipstock connection end 15, body 16 is connected to the whipstock 12 in a number of varying ways as illustrated throughout the drawings and will be discussed as each figure is discussed. At the BHA connection end 17 of the body 16, it is configured for attachment to the BHA 14 through a feature 18. In embodiments, the feature 18 will inherently grip the BHA 14. By "inherently grip", it is meant that the feature in some way will hold onto the BHA 14 without need for additional fastening means. While additional means might be added, they are not required for the body 16 to remain attached to the BHA 14. The feature 18 as illustrated in FIG. 1, includes a number of cantilevered fingers 20 that are in this case configured to nest with flutes 22 in a BHA drilling or milling head 24. Constructing the feature 18 from resilient material aids in assembly to the BHA 14 after formation but it is to be understood that overmolding of the feature to the BHA 14 is also possible. If overmolding is to be used in an embodiment, consideration for length of the assembled arrangement should also be considered. It may be expedient to assemble the arrangement on a rig rather than at a manufactory followed by transport. This will be appreciated by those of skill in the art but it is still possible and contemplated to overmold the arrangement 10. Where the body 16 is overmolded to the BHA or the whipstock, it is contemplated that either of these areas may be adhered to the respective part (BHA or Whipstock) or the overmold may actually extend to portions of these parts such that a mechanical retention is created as well, such as where an overmolded body 16 could extend around the face of a whipstock to a back portion of the whipstock thereby locking the overmolded piece to the whipstock. In any event, the feature 18 will be configured to inherently grip the BHA.

In addition to the fingers 20, some embodiments will include detents 26 positioned on the fingers such that interaction with a profile on the BHA is taken advantage of to secure the fingers to the BHA 14. The fingers themselves and or the detents may also be configured to interact with nozzles or ports 28 of the BHA 14 for additional retention. In each configuration of the feature 18, there will be inherent grip of the BHA 14. This can come from the shape of the feature, size of the feature (interference fit) or an interaction where portions of the feature 18 extend at least more than 50% around the circumference of the BHA 14.

Still referring to FIG. 1, the whipstock connection end 17 of the interconnection body 16 is configured as a hook 30 that passes through a face 32 of whipstock 12 to engage a hollow 34 within the whipstock 12.

Figure 2:
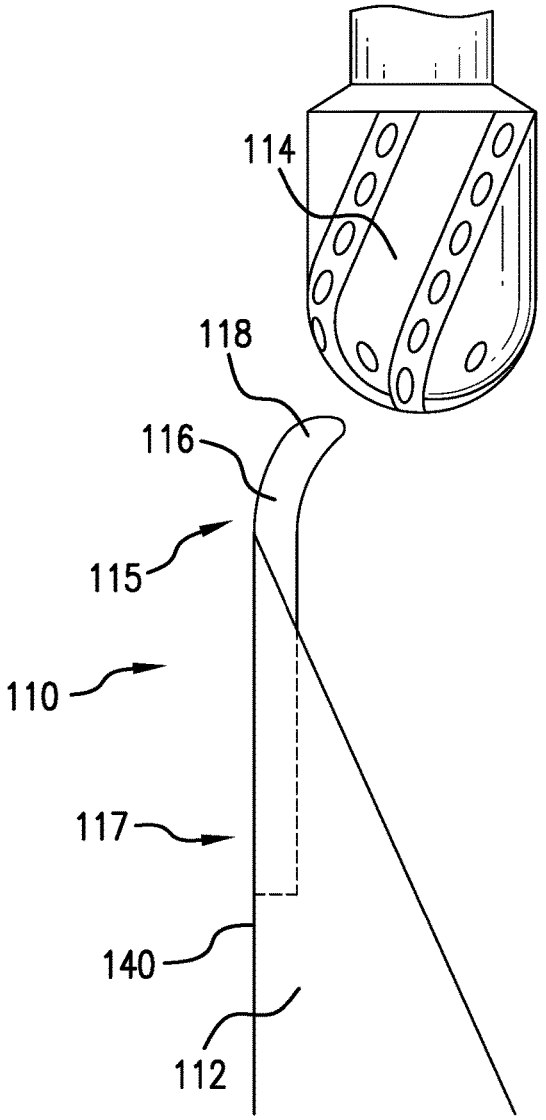
FIG. 2 is a schematic view of another embodiment of a whipstock, bottom hole assembly and whipstock interconnection body.
Figure 2A:
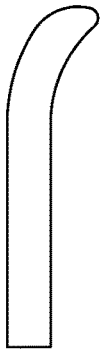
FIG. 2A is a schematic representation of a shape of an interconnection body used in FIG. 2.
Figure 2B:
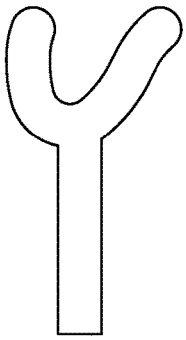
FIG. 2B is a schematic representation of a shape of an interconnection body used in FIG. 2.

Referring to FIG. 2, an alternate embodiment of the interconnection body 116 is illustrated in connection with another embodiment of another whipstock and BHA arrangement 110. In this arrangement, it will be appreciated that the interconnection body 116 does not connect to face 132 of the whipstock 112 as in the FIG. 1 embodiment but rather attached to a back side 140 of the whipstock 112 in this embodiment. The engagement of the body 116 with the backside 140 may be by groove, dovetail, etc., as illustrated and secured therein via fastener or bond (bond being adhesive or material joining such as by weld for example). A feature 118 is extended to engage the BHA 114. FIGS. 2A and 2B illustrate two iterations of this embodiment. This embodiment uses the same concepts of engagement of the BHA connection end of body 116 as did that end of body 16 but without the 360 degree surround illustrated therein, which is not required to make the connection work. Rather merely enough engagement to grip the BHA inherently is all that is necessary for the embodiments to be useful for delivering the whipstock to its intended destination than thereafter release the BHA for a drilling or milling operation.

Figure 3:
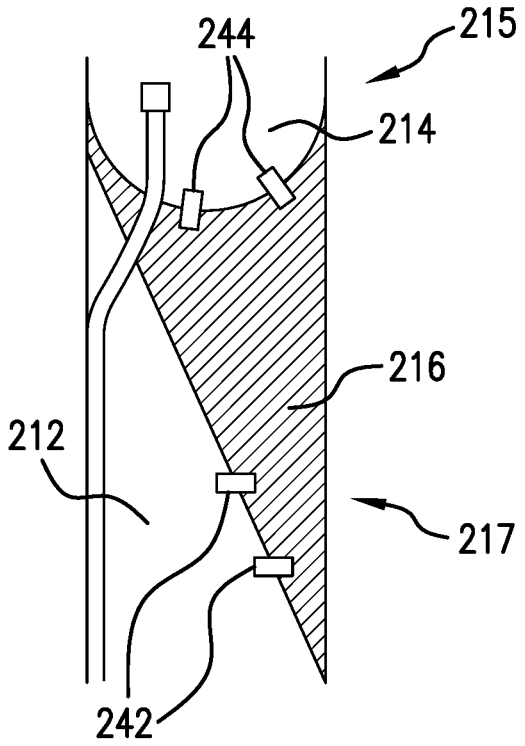
FIG. 3 is a schematic view of yet another embodiment of a whipstock, bottom hole assembly and whipstock interconnection body.

Referring to FIG. 3, another embodiment of a whipstock and BHA arrangement 210 is illustrated. In this embodiment, a whipstock 212 is interconnected with a BHA 214 through an interconnection body 216 that is attached to substantially an entire face 232 of the whipstock 212. The engagement in this location may be by adherence through chemical or mixing bond and or may be through use of fasteners 242. At a BHA connection end 217, the interconnection body 216 may again be adhered chemically or by mixing, may be by fasteners 244 or may use any of the iterations illustrated in FIGS. 1 and 2 (including 2A and 2B). An advantage of the configuration illustrated in FIG. 3 is that due to the close connection there is little movement between the BHA 214 and the whipstock 212 such that a hydraulic or electric line may be fed through from the BHA 214 to the whipstock 212 and beyond.

Figure 4:
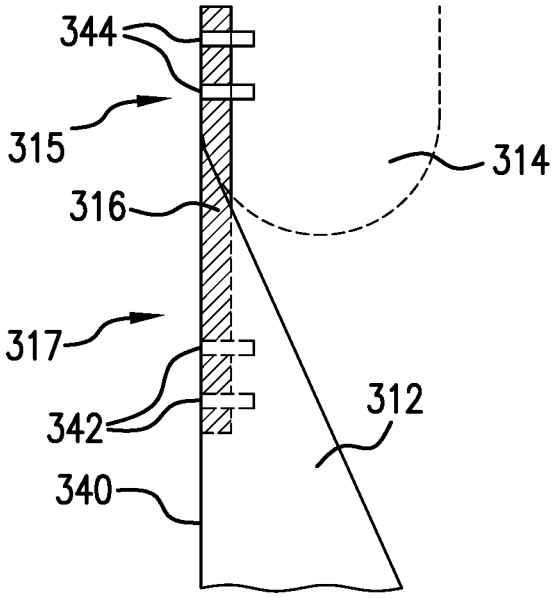
FIG. 4 is a schematic view of yet still another embodiment of a whipstock, bottom hole assembly and whipstock interconnection body.

Finally, referring to FIG. 4, a simpler arrangement is illustrated that does require fasteners at a BHA 314 but achieves advantage in that it is easily drillable material and will need only relatively small fasteners rather than the large lugs common in the industry for the same purpose. Fasteners 342 and 344 are employed to secure an interconnection body 316 to the whipstock 312 and the BHA 314 respectively. It will also be appreciated that the interconnection body 316 is attached to the whipstock 312 at a backside 340 thereof as in embodiments illustrated by FIG. 2. Attachment options are also the same.

It is to be understood that mixing and matching the various disclosed iterations of the various embodiments is contemplated.

Set forth below are some embodiments of the foregoing disclosure:

Embodiment 1

A whipstock interconnection body including a whipstock interface, a bottom hole assembly (BHA) interface, the BHA interface including a feature configured to inherently grip the BHA.

Embodiment 2

The body as in the prior embodiment wherein the feature is resilient.

Embodiment 3

The body as in any prior embodiment wherein the feature wraps more than 50% around the BHA.

Embodiment 4

The body as in any prior embodiment wherein the feature includes a finger.

Embodiment 5

The body as in any prior embodiment wherein the finger is configured to nest in a flute of the BHA.

Embodiment 6

The body as in any prior embodiment wherein the finger engages a fluid port.

Embodiment 7

The body as in any prior embodiment wherein the finger is secured to a fluid port.

Embodiment 8

The body as in any prior embodiment wherein the feature includes a detent.

Embodiment 9

The body as in any prior embodiment wherein the whipstock interface engages a back surface of the whipstock.

Embodiment 10

The body as in any prior embodiment wherein the whipstock interface is adhered to a face of the whipstock.

Embodiment 11

The body as in any prior embodiment wherein the whipstock interface penetrates a face of the whipstock.

Embodiment 12

The body as in any prior embodiment wherein the body comprises a composite material.

Embodiment 13

The body as in any prior embodiment wherein the body comprises a selectively degradable material.

Embodiment 14

A whipstock interconnection body including a whipstock interface, a bottom hole assembly (BHA) interface, the BHA interface configured for attachment to a back surface of the whipstock.

Embodiment 15

The body as in any prior embodiment wherein the attachment configuration is by fastener.

Embodiment 16

The body as in any prior embodiment wherein the attachment configuration is by adherence.

Embodiment 17

A whipstock/BHA assembly including a whipstock, a BHA, a whipstock interconnection body releasably securing the whipstock to the BHA, the whipstock interconnection body including a whipstock interface, a bottom hole assembly (BHA) interface, the BHA interface including a feature configured to inherently grip the BHA.

Embodiment 18

A whipstock/BHA assembly including a whipstock, a BHA, a whipstock interconnection body releasably securing the whipstock to the BHA, the whipstock interconnection body including a whipstock interface, a bottom hole assembly (BHA) interface, the BHA interface configured for attachment to a back surface of the whipstock.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A whipstock/BHA assembly comprising:

a whipstock;

a BHA;

a tubular whipstock interconnection body releasably securing the whipstock to the BHA, the tubular whipstock interconnection body including a plurality of cantilevered resilient fingers nested with a plurality of flutes of the BHA such that only the plurality of cantilevered fingers themselves hold onto the flutes thereby solely axially securing the tubular whipstock interconnection body to the BHA.

2. The assembly as claimed in claim 1 wherein the tubular whipstock interconnection body further includes a whipstock interface.

3. The assembly as claimed in claim 1 wherein at least one finger of the plurality of fingers includes a projection.

4. The assembly as claimed in claim 1 wherein the at least one finger of the plurality of fingers engages a fluid port of the BHA.

5. The assembly as claimed in claim 1 wherein the at least one finger of the plurality of fingers is resilient.

6. The assembly as claimed in claim 1 wherein the plurality of fingers wrap more than 50% around the BHA.

7. The assembly as claimed in claim 1 wherein the tubular whipstock interconnection body is attached to a face of the whipstock.

8. The assembly as claimed in claim 1 wherein the tubular whipstock interconnection body is attached to a back side of the whipstock.

9. The assembly as claimed in claim 1 wherein the tubular whipstock interconnection body comprises a composite material.

10. The assembly as claimed in claim 1 wherein the tubular whipstock interconnection body comprises a selectively degradable material.

* * * * *